US009943158B2

(12) United States Patent
Tarling

(10) Patent No.: US 9,943,158 B2
(45) Date of Patent: Apr. 17, 2018

(54) APPLICATOR WITH ANGLED STEM SECTION

(71) Applicant: L'Oreal, Paris (FR)

(72) Inventor: Christopher Tarling, Clark, NJ (US)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 15/142,600

(22) Filed: Apr. 29, 2016

(65) Prior Publication Data

US 2017/0311697 A1 Nov. 2, 2017

(51) Int. Cl.

| | |
|---|---|
| ***A46B 11/00*** | (2006.01) |
| ***A45D 34/04*** | (2006.01) |
| ***A46B 9/02*** | (2006.01) |
| ***A46B 5/00*** | (2006.01) |

(52) U.S. Cl.

CPC ..... *A45D 34/045* (2013.01); *A46B 5/00* (2013.01); *A46B 9/021* (2013.01)

(58) Field of Classification Search

CPC .. A45D 34/042; A45D 34/046; A45D 40/262; A45D 40/265; A46B 2200/1046; A46B 2200/1053; A46B 5/0033; A46B 5/0037

USPC ..... 401/126, 127, 129

See application file for complete search history.

(56) References Cited

U.S. PATENT DOCUMENTS

| | | | | |
|---|---|---|---|---|
| 5,137,038 | A * | 8/1992 | Kingsford | A45D 40/265 132/218 |
| 5,328,282 | A * | 7/1994 | Charrier | A45D 34/048 401/127 |
| 6,309,125 | B1 * | 10/2001 | Peters | A46B 11/0006 401/126 |
| 8,454,097 | B2 * | 6/2013 | Gueret | A45D 34/045 132/218 |
| 8,568,048 | B2 * | 10/2013 | Chan | A45D 40/265 401/126 |
| 8,881,745 | B2 * | 11/2014 | Pires | A45D 40/265 132/218 |
| 2007/0025803 | A1 * | 2/2007 | Dieudonat | A45D 40/265 401/127 |
| 2008/0107470 | A1 * | 5/2008 | Gueret | A45D 40/265 401/129 |
| 2013/0089368 | A1 * | 4/2013 | Chan | A45D 40/265 401/129 |
| 2015/0359317 | A1 * | 12/2015 | Limongi | A45D 34/045 132/200 |

* cited by examiner

*Primary Examiner* — Jennifer C Chiang
(74) *Attorney, Agent, or Firm* — Christensen O'Connor Johnson Kindness PLLC

(57) ABSTRACT

Cosmetic formula applicators with angled stem sections are provided for improved ergonomics and to aid in the evenly dispersed coating of a cosmetic material having suspended particles. In general, examples of the applicators described herein generally include a stem including a bore, a bar, and a plurality of application bristles configured to retain an amount of the cosmetic formula for application to a user. The bar may be positioned at an intermediate location within the bore and may include a bend to cause an angle in the stem. In another aspect, the cosmetic formula applicators with angled stem sections are configured for coupling to a cap for use with a container.

9 Claims, 8 Drawing Sheets

APPLICATOR WITH ANGLED STEM SECTION

SUMMARY

The present disclosure is directed to, among other things, representative embodiments of an applicator for applying a cosmetic formula. In an embodiment, the applicator includes an elongate stem comprising a bore positioned at a first end of the elongate stem and extending a majority of the elongate stem. The applicator also includes a bar having a bend at an intermediate location within the bore and configured to exhibit plastic deformation. The bar in one embodiments has at least a portion disposed within the bore. The applicator further includes a plurality of application bristles coupled to one of the first end or a second end of the elongate stem. The application bristles in one embodiment are configured to retain an amount of the cosmetic formula for application to a user.

The present disclosure is also directed to one or more embodiments of a cosmetic formula container. In an embodiment, the cosmetic formula container includes an applicator coupled to a cap and extending into an interior cavity of a container body. The applicator in one embodiment has an elongate stem having a first stem segment and a second stem segment disposed at an angle to the first stem segment. A plurality of application bristles are coupled to an end of the second stem segment. The application bristles in one embodiment are configured to retain an amount of the cosmetic formula for application to a user.

The present disclosure is also directed to one or more embodiments of a method of manufacturing a cosmetics applicator having an intermediate bend in a stem. In an embodiment, the method includes obtaining the stem with a bore positioned along the stem and extending a majority of the stem; positioning a bar within the bore of the stem; and applying a bending force to the intermediate section of the stem to produce a final bend angle between about 5 degrees and about 30 degrees.

In accordance with any of the embodiments described herein, the applicator may further include a coupler positioned at the end of the elongate stem opposite the application bristles, the coupler having a coupling portion, wherein the bore in the elongate stem may extend through the body and the coupling portion.

In accordance with any of the embodiments described herein, the coupling portion may be configured to interface with a threaded cap.

In accordance with any of the embodiments described herein, the interface between the coupler and the elongate stem may be reinforced by a tapered portion.

In accordance with any of the embodiments described herein, the bar may be bent at an angle between about 5 degrees and about 30 degrees from a centerline of the bore.

In accordance with any of the embodiments described herein, the bar may be bent at an angle between about 15 degrees and about 25 degrees from a centerline of the bore.

In accordance with any of the embodiments described herein, the bar may include a material selected to permanently retain the bend.

In accordance with any of the embodiments described herein, the applicator may further include a bore positioned at a first end of the elongate stem and extending a majority of the elongate stem; and a bar, at least a portion of which is disposed within the bore, wherein the bar may be configured to exhibit plastic deformation, and wherein the bar may be bent past plastic deformation in proximity to an intersection between the first stem segment and the second stem segment such that the second stem segment is disposed at the angle to the first stem segment.

In accordance with any of the embodiments described herein, the applicator may further include a coupler coupled to the end of the elongate stem opposite the application bristles, the coupler having a coupling portion projecting from the body away from the elongate stem for coupling the applicator to the cap.

In accordance with any of the embodiments described herein, the interface between the coupler and the elongate stem may be reinforced by a tapered portion.

In accordance with any of the embodiments described herein, the cap may couple to the neck of the container body using a mechanical coupling selected from the group consisting of threads, press fit, turn to lock, and interlock.

In accordance with any of the embodiments described herein, the bar may be bent such that the application bristles are in proximity of a side wall of the container.

In accordance with any of the embodiments described herein, the application bristles may be positioned between about 1/10 of 1 millimeter and about 10 millimeters away from the side wall.

In accordance with any of the embodiments described herein, the bar may be bent further than the final bend angle to counteract springback.

In accordance with any of the embodiments described herein, the positioning of the bar within the bore may include injecting a liquid metal into the bore.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the disclosed subject matter will become more readily appreciated as the same become better understood by reference to the following detailed description, when taken in conjunction with the accompanying drawings, wherein.

DETAILED DESCRIPTION

The following description provides several examples that relate to cosmetic applicators. In that regard, application of a wide variety of cosmetic formulas to human nails is a common practice. Some examples of such cosmetic formula include nail polish, shellac, glitter, clearcoat, nail supplements, nail proteins, etc. To apply the cosmetic formula, an applicator can be used. Generally described, an applicator includes a brush or a similarly structured portion at one end that retains formula for application to the nails. The opposite end of the applicator is grasped during use. For users who are self-applying the cosmetic formula, improving ergonomics may, for example, ease the transition from the dominant hand to the non-dominant hand during application.

Figure 1:
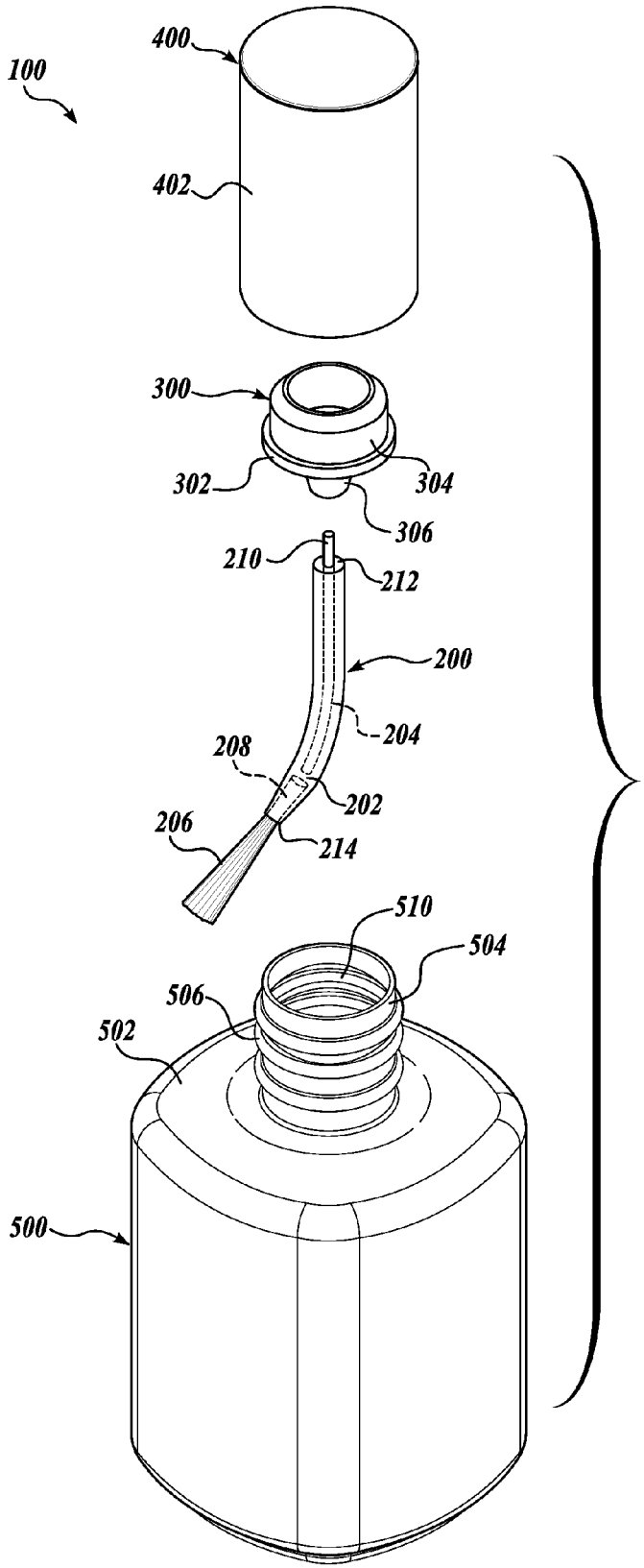
FIG. 1 is an exploded view of one representative embodiment of a cosmetic formula container in accordance with an aspect of the present disclosure.

FIG. 1 shows one representative embodiment of an applicator for implementing one or more methodologies or technologies such as, for example, providing an evenly dispersed coat of a cosmetic material having suspended particles. For example, high pigment particle cosmetic formula (e.g., glitter suspended in nail clearcoat liquid, etc.), require proper mixing to obtain an evenly dispersed coat of the suspended particles. But these suspended particles often tend to adhere to the sides of the bottle. Conventional applicators are unable to reach the sides of the bottle to remove the suspended particles. As a result, each application of the cosmetic formula may not have evenly dispersed particles.

Accordingly, to address the deficiencies in conventional applicators, and others, embodiments of the present disclosure relate to an applicator that enhances the mixing of the cosmetic formula and provides improved ergonomics for use with both a user's left and right hands. To achieve these benefits and others, some embodiments of the applicator disclosed herein include an angled or bent stem for applying a substrate in fluid form, such as a cosmetic formula and/or the like, to a user.

The embodiments illustrated in the FIGURES have been designed for use with cosmetic formulas applied to the user's fingernails and toenails (e.g., polish, shellac, glitter, clearcoat, supplements, protein, etc.). Embodiments of the present disclosure are also suitable for applying a cosmetic formula to any surface of the user's body.

Embodiments of the applicator disclosed herein are suitable for use with standard cosmetic formula bottles, among others. In one embodiment, the cosmetic formula bottle generally includes a neck and an interior cavity configured to hold a quantity of cosmetic formula. The neck is configured to interface with a cap in a removably couplable manner for enclosing the cosmetic formula within the bottle. In one embodiment, the cap is adapted to be coupled to the applicator. In certain embodiments disclosed herein, the cosmetic formula bottle is about 15 centimeters or smaller in height, about 7.5 centimeters or smaller in width or diameter, and contains less than 0.5 liters of cosmetic formula. In an embodiment, a major dimension of the cosmetic formula bottle ranges from about 2 centimeters to about 15 centimeters. In an embodiment, a major dimension of the cosmetic formula bottle ranges from about 2 centimeters to about 7 centimeters. In an embodiment, the volume of the cosmetic formula bottle ranges from about 0.08 fluid ounces (fl. oz.) to about 20 fl. oz. In an embodiment, the volume of the cosmetic formula bottle ranges from about 0.08 fluid ounces (fl. oz.) to about 3 fl. oz. In an embodiment, the volume of the cosmetic formula bottle ranges from about 0.08 fluid ounces (fl. oz.) to about 1 fl. oz. In an embodiment, the volume of the cosmetic formula bottle ranges from about 0.08 fluid ounces (fl. oz.) to about 0.5 fl. oz. In an embodiment, the volume of the cosmetic formula bottle ranges from about 2.5 milliliters (ml) to about 600 ml. In an embodiment, the volume of the cosmetic formula bottle ranges from about 2.5 milliliters (ml) to about 100 ml. In an embodiment, the volume of the cosmetic formula bottle ranges from about 2.5 milliliters (ml) to about 50 ml. In an embodiment, the volume of the cosmetic formula bottle ranges from about 2.5 milliliters (ml) to about 15 ml.

Figure 2:
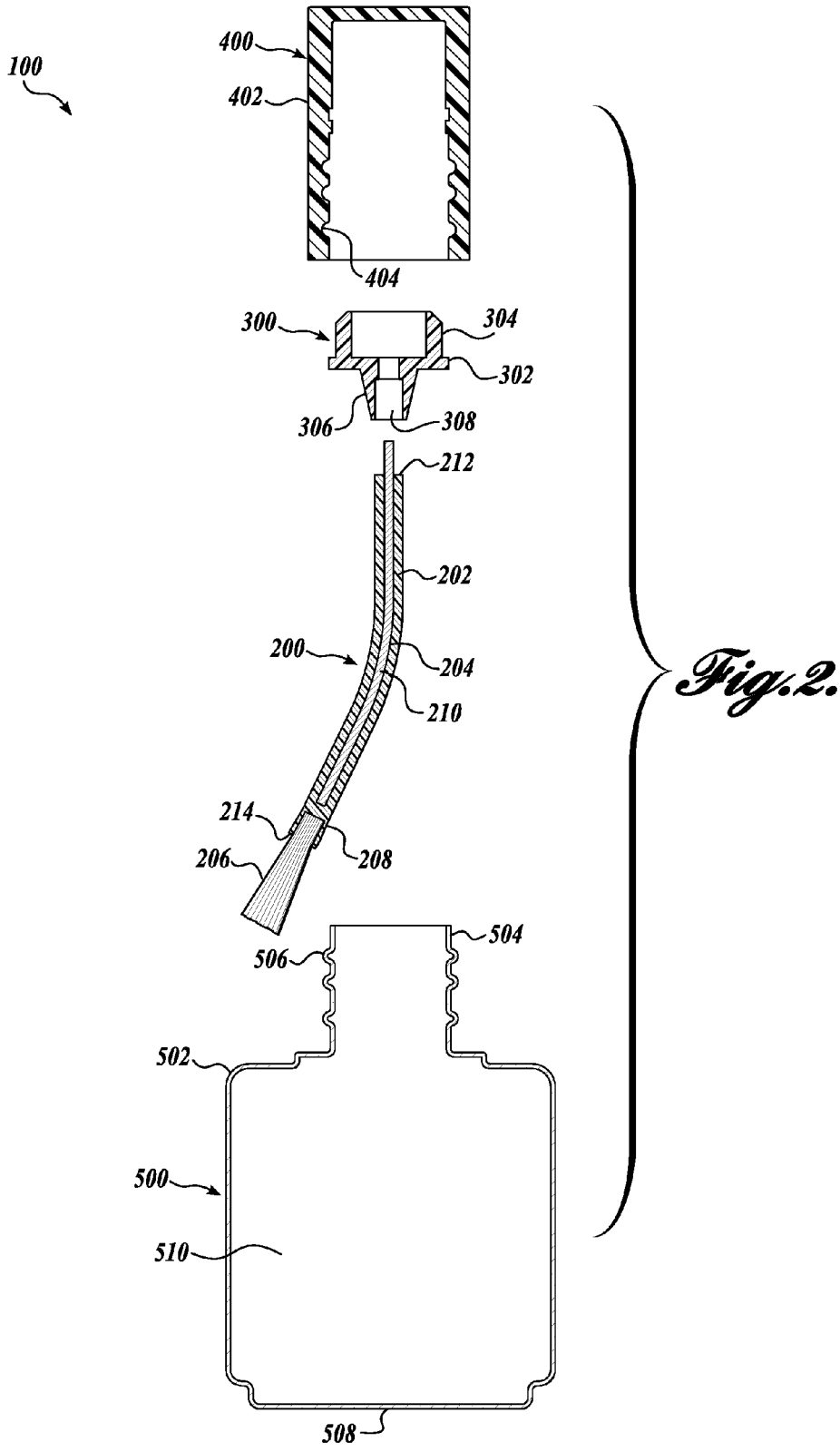
FIG. 2 is an exploded, cross-sectional view of the cosmetic formula container of FIG. 1.
Figure 3:
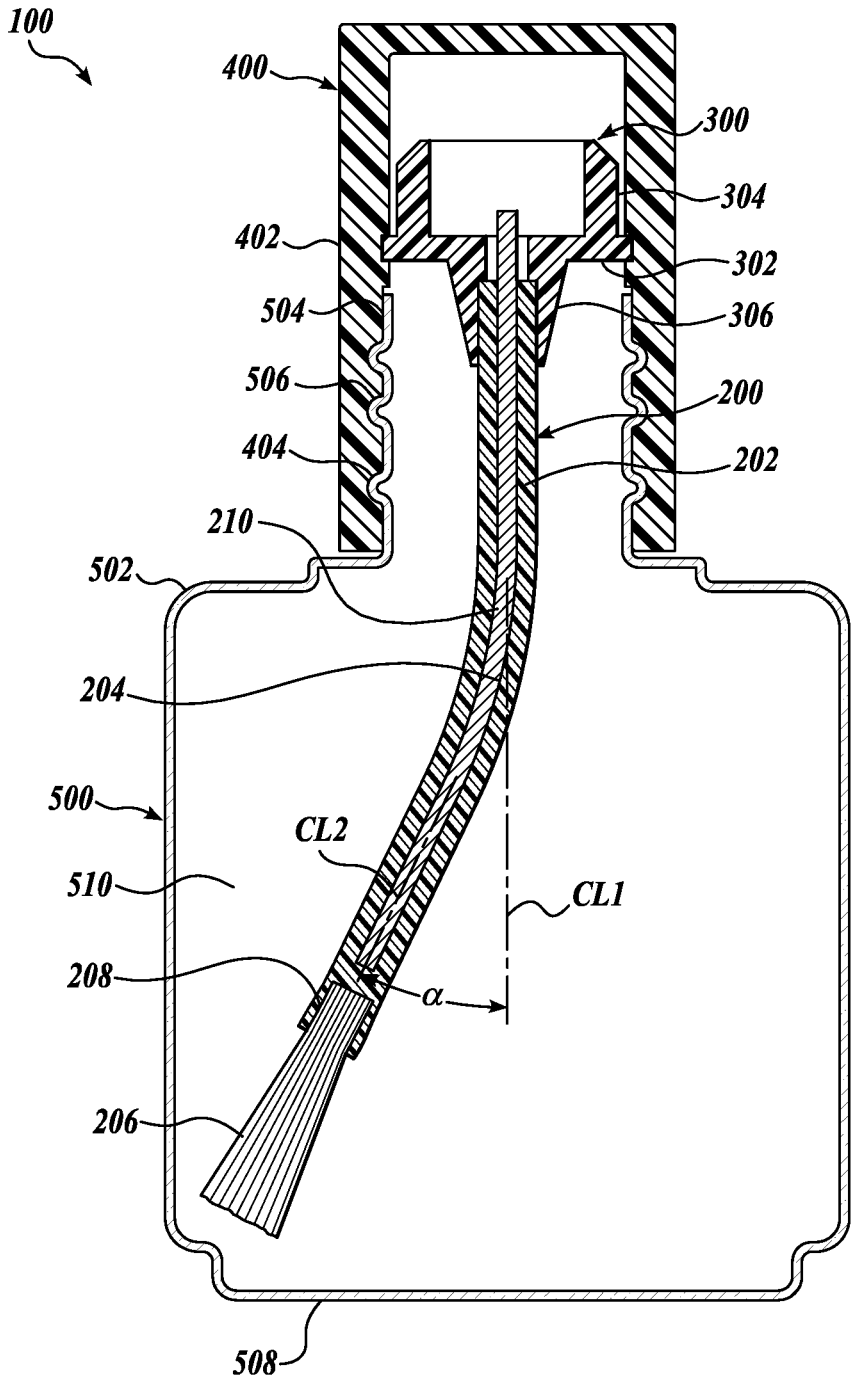
FIG. 3 is an assembled, cross-sectional view of the cosmetic formula container of FIG. 1.

Referring now to FIGS. 1-3, there is shown one embodiment of a cosmetic formula container, generally designated 100, in accordance with one or more aspects of the present disclosure. In the illustrated embodiment, the cosmetic formula container 100 generally includes an applicator 200, a cap 400, and a cosmetic bottle 500. In some embodiments, the cosmetic formula container 100 may include an applicator coupler 300 for coupling the applicator 200 to the cap 400. When assembled, the cap 400 is removably coupled to the cosmetic bottle 500, and the applicator 200 extends into the interior of the cosmetic bottle 500. It will be appreciated in some embodiments the applicator 200 can be directly coupled to the cap 400, omitting the applicator coupler 300. In yet other embodiments, the applicator 200 is a separate device, which is not coupled to the cap 400.

Still referring to FIGS. 1-3, each component of the container 100 will be described in more detail. FIGS. 1-3 illustrate one embodiment of the applicator 200 in accordance with an aspect of the present disclosure. As shown in FIG. 1, the applicator 200 includes an elongated stem 202 having a distal end 214 to which a plurality of bristles 206 are fixedly secured. To aid in fixedly securing the plurality of bristles 206 to the elongated stem 202, a bristle cavity 208 is provided. In one embodiment, to attach the plurality of bristles 206 to the stem 202, common ends of the plurality of bristles 206 are inserted into the bristle cavity 208 at the distal end 214 of the stem 202. In some embodiments, the distal end 214 is crimped around the inserted plurality of bristles 206 to retain the plurality of bristles 206 within the bristle cavity 208. In other embodiments, the plurality of bristles 206 are retained using a suitable adhesive, heat bonding, press fit, or a mechanical fastener, such as a staple (not shown). However, in other embodiments, the bristle cavity 208 can be omitted and the plurality of bristles 206 are attached directly to the distal end 214 of the elongated stem 202 using any suitable retention technique.

The elongated stem 202 of the applicator 200 is of suitable length and diameter for the plurality of bristles 206 to interface the cosmetic formula within the cosmetic bottle 500. In this regard, in some embodiments, the elongated stem 202 is of a length such that the free ends of the plurality of bristles 206 contact an interior bottom of the cosmetic bottle 500 when the cosmetic formula container 100 is closed. In other embodiments, the elongated stem 202 is of a length such that the free ends of the plurality of bristles 206 are between about 1 millimeter and about 25 millimeters away from the interior bottom of the cosmetic bottle 500 when the cosmetic formula container 100 is closed. In further embodiments, the elongated stem 202 is of a length such that the free ends of the plurality of bristles 206 are between about 1 millimeter and about 5 millimeters away from the interior bottom of the cosmetic bottle 500 when the cosmetic formula container 100 is closed. The elongated stem 202 has a diameter suitable to pass through a neck 504 of the cosmetic bottle 500 to interface the cosmetic formula therein.

Figure 4A:
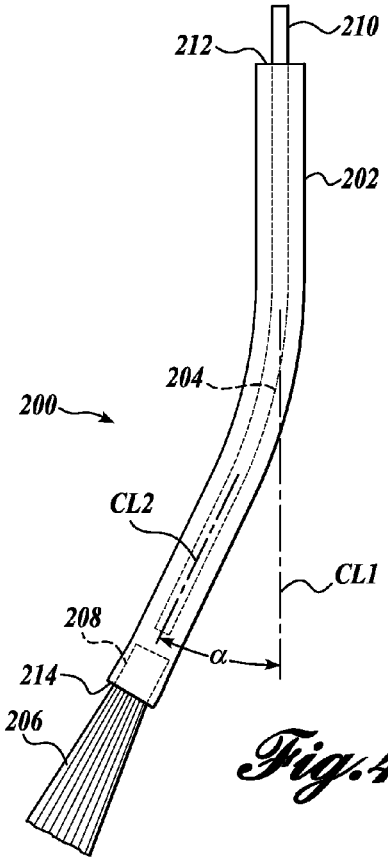
FIG. 4*a* is a front view of one representative embodiment of an applicator in accordance with an aspect of the present disclosure.
Figure 4B:
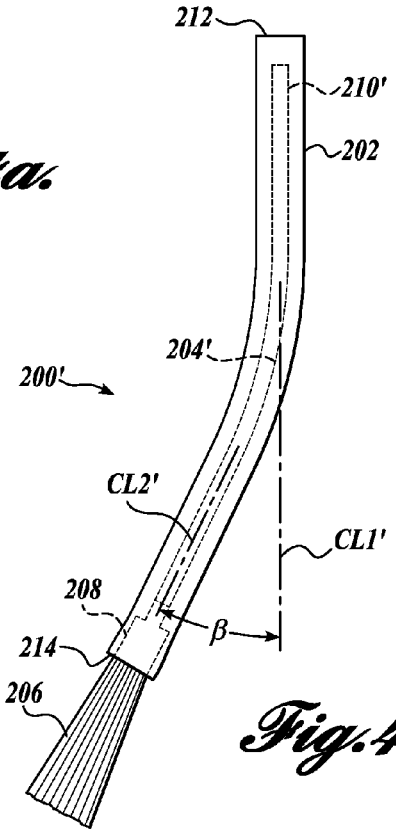
FIG. 4*b* is a front view of another representative embodiment of an applicator in accordance with an aspect of the present disclosure.
Figures 5A, 5B, 5C, 5D:
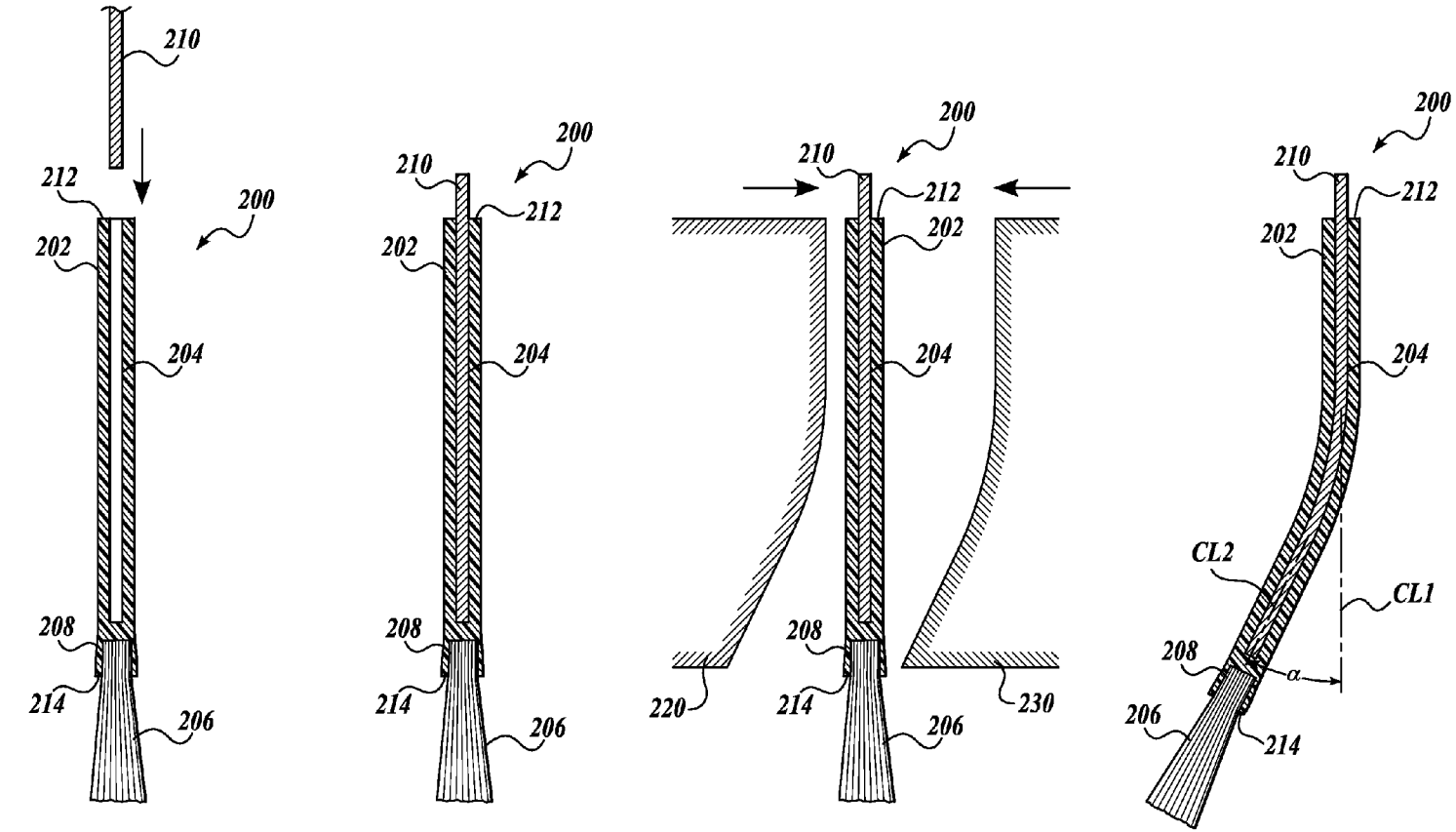
FIGS. 5*a*-5*d* schematically illustrate one representative embodiment of a method of manufacturing the cosmetics applicator of FIG. 4*a;*

In the embodiment shown in FIGS. 1-4*a*, the applicator 200 is bent or includes a bent section, the benefits of which will be described in more detail below. In some embodiments, the applicator 200 includes a bend of bend angle $\alpha$ at an intermediate position on the stem 202. In that regard, the stem 202 includes a first stem segment and a second stem segment disposed at bend angle α to the first stem segment. The angle α is the included angle between a proximal centerline CL1 (or axis) of a central bore 204 near a proximal end 212 of the stem 202, and a distal centerline CL2 (or axis) of the central bore 204 near the distal end 214 of the stem 202 (see FIGS. 4*a* and 5*d*). Likewise, as shown in FIGS. 4*b* and 6*f*, an angle β is the included angle between a proximal centerline CL1' (or axis) of a central bore 204' near a proximal end 212 of the stem 202, and a distal centerline CL2' (or axis) of the central bore 204' near the distal end 214 of the stem 202.

In some embodiments, the bend angle α is between about 5 degrees and about 30 degrees. In other embodiments, the bend angle α is between about 15 degrees and about 25 degrees. In yet other embodiments, the bend angle α is between about 18 degrees and about 22 degrees. In further embodiments, the bend angle α is any suitable angle such that the free end of the bristles 206 is positioned to contact an interior wall of the cosmetic bottle 500 when the cosmetic formula container 100 is closed. In other embodiments, as shown clearly in FIG. 3, the bend angle α is any suitable angle such that the free end of the bristles 206 are in proximity of the interior wall of the cosmetic bottle 500. In this regard, the free ends of the bristles 206 in some embodiments are positioned between about 1/10 of 1 millimeter and about 10 millimeters away from an interior wall of the cosmetic bottle 500 when the cosmetic formula container 100 is closed. In other embodiments, the bend angle α is any suitable angle such that the free ends of the bristles 206 are positioned between about 1/10 of 1 millimeter and about 5 millimeters away from an interior wall of the cosmetic bottle 500 when the cosmetic formula container 100 is closed.

In some embodiments, the intermediate position of the bend of the stem 202 is located at a distance of about 10% to about 90% of the length of the stem 202. In other embodiments, the intermediate position of the bend of the stem 202 is located at a distance of about 30% to about 70% of the length of the stem 202. Still, in further embodiments, the intermediate position of the bend of the stem 202 is located at a distance of about 40% to about 60% of the length of the stem 202.

The bend in the applicator 200 creates a plunging effect as it is inserted into the cosmetic bottle 500. When the applicator is removed from the cosmetic bottle 500, it has a scooping effect. For high pigment particles, such as glitter suspended in a nail clearcoat liquid, the plunging and scooping effects promote mixing of the cosmetic formula for an evenly spaced application of the suspended particles. In addition, the bend in the applicator 200 improves the ergonomics of the applicator 200. The ergonomic improvement may be most readily noticeable when the user holds the applicator in their non-dominant hand.

To form the bend in the applicator 200, one embodiment of the stem 202 includes the central bore 204 that extends from one end of the stem through a majority of elongate stem 202, and a rod, bar, or other elongate member, generally designated as a bar 210. As shown in FIG. 4*a*, in some embodiments, the bore 204 is open at the proximal end 212 of the stem 202, such that the bar 210 can be inserted into the central bore 204, as described in more detail below. In other embodiments, the central bore 204 is open at the distal end 214 (see, e.g., FIG. 4*b*), such that the bar 210 can be inserted into the bore 204 from the distal end 214. As shown in the comparison of FIG. 4*a* to FIG. 4*b*, in some embodiments, the bar 210 can protrude from the central bore 204 (FIG. 4*a*). In other embodiments, the bar 210 can be completely enclosed within the central bore 204 (see, e.g., FIG. 4*b*). In yet other embodiments, the bore is closed at both the proximal end 212 and the distal end 214 and completely encloses the bar 210 within the stem 202. In this embodiment, the stem 202 is molded to surround the bar 210 such that it is enclosed within the stem 202. As explained in more detail below, and shown in representative form in FIGS. 6*a*-6*f*, the bar 210 in other embodiments is formed within the bore 212 by an injection metal process from either the proximal end 212 or the distal end 214.

Still referring to FIGS. 4*a* and 4*b*, the bar 210 is made from a material that exhibits plastic deformation, e.g., metal, some thermoplastics, etc. As a non-limiting example, the bar 210 may be made from steel, such as stainless steel. The bar 210 disposed within the stem 202 allows the applicator 200 to retain the bent shape having bend angle α. In some embodiments, the stem 202 is formed without the intermediate bend (see e.g., FIG. 5*a*, stem portion 602). In this regard, a straight bar 210 is inserted into the stem 202 and then bent to bend angle α, as explained in more detail below. In other embodiments, the bar 210 is formed with the bend angle α before being inserted into the stem 202. In the illustrated embodiments, the bar 210 is depicted as cylindrical. In other embodiments, the bar 210 has other cross-sectional shapes, such as square, oval, rectangular, triangular, or any other suitable shape. It will be appreciated that the stem is made from a material that allows bending by the bar 210 without affecting the integrity of the stem. As a non-limiting example, the stem 202 can be made from plastic, such as nylon, high-density polyethylene (HDPE), low-density polyethylene (LDPE), etc., or a mixture thereof.

Returning now to FIGS. 1-3, the container also includes a cap 400 and a cosmetic bottle 500. The cosmetic bottle 500 includes bottle body 502 that forms an interior cavity 510 configured to hold a preselected quantity of cosmetic formula. Non-limiting examples of formulas include cosmetic formulations, treatment formulations, nail care formulation, cosmetic products, care products, nail polish cosmetic compositions, Ultraviolet (UV) curable cosmetic nail gel compositions, anti-fungal compositions, color cosmetic compositions, nail care cosmetic formulations, lip care cosmetic formulations, eye cosmetic formulations, eye treatment compositions, and the like.

Further non-limiting examples of formulas include cuticle care formulations (e.g., apricot cuticle oil formations, hydrating formulations, and the like); based coat formulations (e.g., strengtheners, rubber adhesives, primers, color adhesives, anti-break compositions, ridge fillers, and the like); treatment formulations (e.g., nutra-keratin formulations, bamboo extract formulations, ridge filler formulations, anti-chip formulations, and the like); top coat formulations (e.g., GEL•SETTER™, shine, polish, matte finisher, anti-chip, color adhesive, primer, quick drying, and the like); and the like. In one embodiment, the cosmetic formula includes nail care cosmetic compositions.

The cosmetic bottle also includes the neck 504 for interfacing with the cap 400. The neck 504 extends from the bottle body 502 with a smaller cross-section than the bottle body 502. The cap 400 selectively attaches to the neck 504 of the cosmetic bottle 500 using a mechanical coupling, such as press fit, turn to lock, interlock, etc. In the illustrated embodiment shown in FIG. 3, the cap 400 selectively attaches via internal cap threads 404 that engage cooperatingly configured bottle threads 506 disposed on the neck 504. In several embodiments, the threaded cap 400 is configured to closely interface with the neck 504 to provide a hermetic seal, keeping the cosmetic formula from escaping the bottle cavity 510, evaporating, etc.

In some embodiments, the cap 400 is adapted to be coupled to the applicator 200. In the embodiment shown, the applicator 200 is coupled to the cap 400 via the applicator coupler 300. In this regard, the cap 400, the applicator 200, and the applicator coupler 300 in some embodiments function as a single unit during application of the cosmetic formula to the user. In other embodiments, the cap 400 is integral to the applicator 200 such that together the components form a single unit. Still, in other embodiments, the applicator 200 remains a separate component such that the cap 400 is removed from the cosmetic bottle 500 to reveal the applicator 200 prior to application of the cosmetic formula.

Still referring to FIGS. 1-3, one embodiment of the applicator coupler 300 will be described in more detail. The applicator coupler 300 provides one representative technique for coupling the applicator 200 to the cap 400, although other techniques or methodologies can be practiced with embodiments of the present disclosure. As shown in FIG. 1-3, the applicator coupler 300 includes a coupler body 302, a coupler protrusion 304, and a stem coupler 306. The coupler protrusion 304 is configured to interface with the cap 400 and retain the applicator coupler 300 therewith. In this regard, the applicator coupler 300 interfaces with the cap 400 using a press fit, threads, glue, or any other suitable mechanical coupling.

The stem coupler 306 is configured for attaching the stem 202 of the applicator 200 to the applicator coupler 300. In some embodiments, the stem coupler 306 is configured with a socket 308 or the like configured for receiving the proximal end 212 of the stem 202 in a press fit manner. In other embodiments, the proximal end 212 of the stem 202 can be glued, heat bonded, etc., to the stem coupler 306. In the illustrated embodiments, the stem coupler 306 optionally includes a tapered shape to increase strength and reduce failure of the coupling; however, in other embodiments, the stem coupler 306 is any suitable shape capable of retaining the stem 202 of the applicator assembly 200. As shown, in some embodiments, the bore 204 is open through the coupler body 302 and the coupler protrusion 304 such that the bar 210 can be inserted into the bore 204 with the applicator coupler 300 coupled to the stem 202. In other embodiments, the features of the applicator coupler 300 are integral to the applicator assembly 200 and the separate applicator coupler 300 is omitted from the cosmetic formula container 100.

Embodiments of a method of manufacturing a cosmetics applicator, such as the applicators 200 and 200' of FIGS. 4*a* and 4*b*, respectively, will now be described with reference to FIGS. 5*a*-5*d*, FIGS. 6*a*-6*f*, and FIG. 7. Referring now to FIG. 7, one representative method 600 of manufacturing an applicator starts and progresses to block 602, in which a stem is obtained having a central bore positioned along a majority of the stem. For example, at block 602, either stem 202 or stem 202' is obtained. As described briefly above, the stem 202 includes a central bore 204 that is open at the proximal end 212 and extends toward the distal end 214 along a majority of the stem 202, as shown in FIG. 5*a*. Similarly, the stem 202' includes a central bore 204' that opens at bristle cavity 208 and extends toward the proximal end 212 along a majority of the stem 202', as shown in FIG. 6*a*.

Next, in block 604, a bar, rod, or similar structure is inserted into or otherwise formed within the bore of the respective stem. For example, a bar 210 is inserted into the bore 204 at the proximal end 212 of the stem 202, as shown in FIGS. 5*a* and 5*b*. In FIG. 5*b*, the bar 210 is inserted into the stem portion 202. In the illustrative embodiment, the bar 210 is sized to slidably seat within the bore 204. Additionally, the bar 210 is shown as slightly longer than the bore 204 such that it protrudes out of the proximal end 212 of the stem 202. In other embodiments, the bar 210 is shorter than the bore 204 such that the bar 210 is fully inserted into the bore 204 prior to bending (described in further detail below). In other embodiments, the bar 210 is does not seat against the end of the bore 204.

Figure 6A:
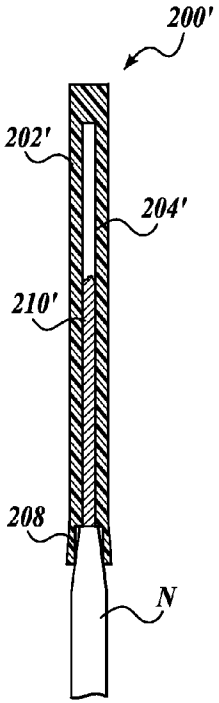
FIGS. 6*a*-6*f* schematically illustrate one representative embodiment of a method of manufacturing the cosmetics applicator of FIG. 4*b*.
Figure 6B:
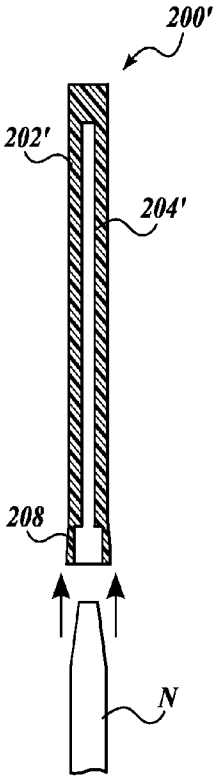
Figure 6C:
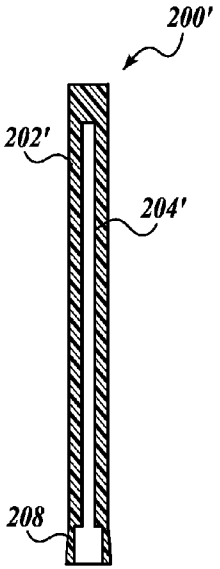
Figure 6F:
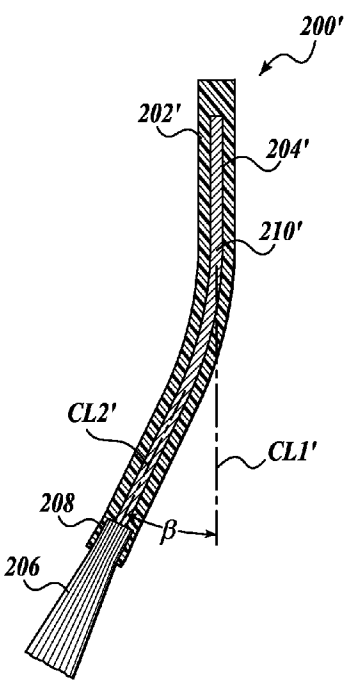
Figure 7:
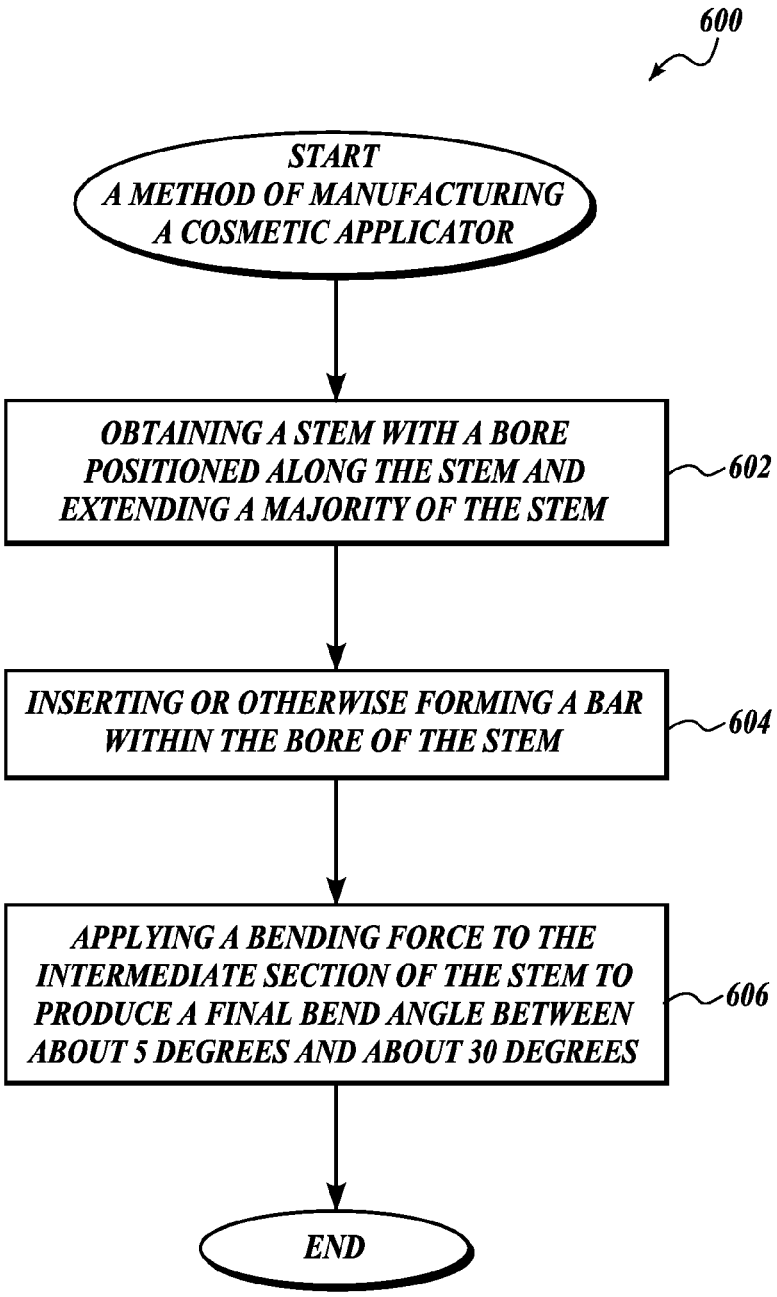
FIG. 7 is a flow chart depicting one representative method of manufacturing a cosmetic applicator in accordance with one or more aspects of the present disclosure.

In other embodiments, a bar 210', or like structure, is formed within the bore 204' of the stem 202, as shown in FIGS. 6*a*-6*c*. For example, the bar 210', or like structure, is injection formed via a nozzle N. In that regard, a nozzle N is brought into close proximity or engagement with the bristle cavity 208 of the stem 202' for injecting a material into the bore 204'. The material injected exhibits the same material property of plastic deformation as the bar 210, as previously described. FIG. 6*c* depicts a partially formed bar 210' within bore 204' during the filling process from the nozzle N, and the bar 210' is shown as filling the entire bore 204' in FIG. 6*d*. In other embodiments, the bar 210' does not entirely fill the bore 204'. It will be appreciated that the injection of the material using the nozzle N in other embodiments can occur on the proximal side of the applicator, such as with the stem 202 of FIG. 5*a*.

In some embodiments, the plurality of bristles 206 are coupled within the bristle cavity 208 of the stem 202 before insertion of the bar 210 into the stem 202. In other embodiments, the bristles 206 are coupled to the stem 202 after insertion of the bar 210. For simplicity, the illustrated embodiment of FIGS. 5*a*-5*c* are shown with the bristles 206 attached to the stem 202 before insertion of the bar 210. In yet other embodiments, such as the embodiment shown in FIGS. 6*a*-6*f*, the bristles 206 are coupled to the stem 202 after formation of the bar 210'. In other embodiments, the bristles 206 can be coupled to the stem during any suitable step of the manufacturing process.

Figure 6E:
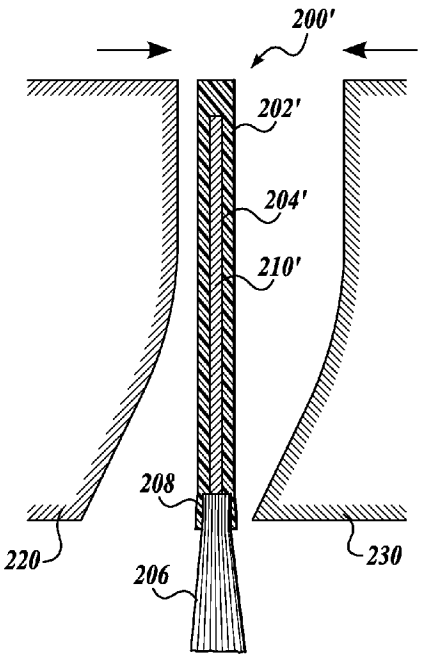
Figure 6D:
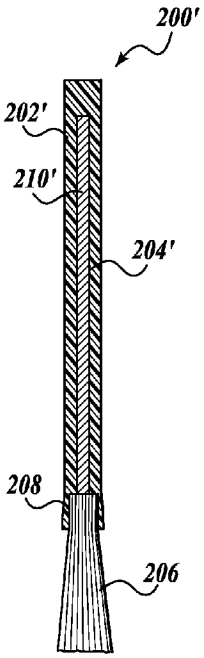

From block 604, the process continues to block 606, where a bending force is applied to an intermediate section of the stem, producing a final bend angle between about 5 degrees and about 30 degrees. For example, as shown in FIG. 5*c* or 6*e*, cooperating convex and concave molds 220, 230 are placed on respective sides of the applicator 200 or 200'. As shown, the convex mold 220 and the concave mold 230 move toward each other, causing the bar 210 or 210' to bend within the respective stem 202 or 202'. The bar 210 or 210', having a material property that exhibits plastic deformation, allows the bar to retain the bent shape of the bend angle $\alpha$ or $\beta$ and translates the bent shape to the stem portion 202 or 202' at bend angle $\alpha$ or $\beta$, respectively. In other embodiments, as previously described, the bar 210 or 210' is bent to bend angle $\alpha$ or $\beta$ prior to insertion into the stem portion 202 or 202', respectively. In some embodiments, the bar 210 or 210' is bent beyond the bend angle $\alpha$ or $\beta$ to account for slight springback of the bar 210 or 210' such that the final bend is at the bend angle $\alpha$ or $\beta$, respectively. After the applicator 200 or 200' is constructed, it can be associated with a cap, such as the cap 400 described above.

The detailed description set forth above in connection with the appended drawings, where like numerals reference like elements, are intended as a description of various embodiments of the present disclosure and are not intended to represent the only embodiments. Each embodiment described in this disclosure is provided merely as an example or illustration and should not be construed as preferred or advantageous over other embodiments. The illustrative examples provided herein are not intended to be exhaustive or to limit the disclosure to the precise forms disclosed. Similarly, any steps described herein may be interchangeable with other steps, or combinations of steps, in order to achieve the same or substantially similar result.

In the foregoing description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may include references to directions, such as "forward," "rearward," "front," "back," "upward," "downward," "right hand," "left hand," "lateral," "medial," "in," "out," "extended," "advanced," "retracted," "proximal," "distal," "central," etc. These references, and other similar references in the present application, are only to assist in helping describe and understand the particular embodiment and are not intended to limit the present disclosure to these directions or locations.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number. In this regard, the term "plurality" is meant to be any number that is more than one, for example, two, three, four, five, etc. The term "about," "approximately," etc., means plus or minus 5% of the stated value.

The principles, representative embodiments, and modes of operation of the present disclosure have been described in the foregoing description. However, aspects of the present disclosure, which are intended to be protected, are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure as claimed.

The embodiments of the invention in which an exclusive property or privilege is claimed are defined as follows:

1. A cosmetic formula container, comprising:

an applicator coupled to a cap and extending into an interior cavity of a container body, the applicator having an elongate stem having a first stem segment, a second stem segment disposed at an angle to the first stem segment, and a bore positioned at a first end of the elongate stem and extending a majority of the elongate stem;

a plurality of application bristles coupled to an end of the second stem segment, the application bristles configured to retain an amount of the cosmetic formula for application to a user; and a bar, at least a portion of which is disposed within the bore, wherein the bar is configured to exhibit plastic deformation, and wherein the bar is bent past plastic deformation in proximity to an intersection between the first stem segment and the second stem segment such that the second stem segment is disposed at the angle to the first stem segment.

2. The cosmetic formula container of claim 1, wherein the applicator further comprises a coupler coupled to the end of the elongate stem opposite the application bristles, the coupler having a coupling portion projecting from the body away from the elongate stem for coupling the applicator to the cap.

3. The cosmetic formula container of claim 2, wherein the interface between the coupler and the elongate stem is reinforced by a tapered portion.

4. The cosmetic formula container of claim 1, wherein the cap couples to the neck of the container body using a mechanical coupling selected from the group consisting of threads, press fit, turn to lock, and interlock.

5. The cosmetic formula container of claim 1, wherein the bar is bent such that the application bristles are in proximity of a side wall of the container.

6. The cosmetic formula container of claim 5, wherein the application bristles are between about 1/10 of 1 millimeter and about 10 millimeters away from the side wall.

7. The cosmetic formula container of claim 1, wherein the bar is bent at an angle between about 5 degrees and about 30 degrees from a centerline of the bore.

8. The cosmetic formula container of claim 1, wherein the bar is bent at an angle between about 15 degrees and about 25 degrees from a centerline of the bore.

9. The cosmetic formula container of claim 1, wherein the bar includes a material selected to permanently retain the bent shape.

* * * * *